United States Patent [19]

Sandlin

[11] 4,114,209

[45] Sep. 19, 1978

[54] TILTING ATTACHMENT FOR A BED

[76] Inventor: Joseph P. Sandlin, Rte. 1, Box 550, Williston, Fla. 32696

[21] Appl. No.: 801,475

[22] Filed: May 31, 1977

[51] Int. Cl.[2] ..... A61G 7/06

[52] U.S. Cl. ..... 5/62; 5/108; 248/370

[58] Field of Search ..... 5/61, 62, 63, 64, 65, 5/108, 60, 184; 248/139, 370

[56] References Cited

U.S. PATENT DOCUMENTS

| | | | |
|---|---|---|---|
| 272,077 | 2/1883 | Mueller | 5/184 |
| 1,043,517 | 11/1912 | Gavan | 5/62 |
| 3,013,281 | 12/1961 | Steiner | 5/62 |
| 3,247,528 | 4/1966 | Swenson et al. | 5/62 |
| 3,748,666 | 7/1973 | Seng | 5/61 |
| 4,006,499 | 2/1977 | Young | 5/62 |

*Primary Examiner*—Mervin Stein
*Assistant Examiner*—Alex Grosz
*Attorney, Agent, or Firm*—James B. Middleton

[57] ABSTRACT

An attachment for conventional beds whereby a bed is made to tilt, rotating generally about the centerline of a person lying in the bed, the attachment including a pair of stanchions, each stanchion having a stirrup pivotally connected thereto, each stirrup having cups for receiving the feet of a bed, and a tilt control means for shifting the stirrup with respect to the stanchion, the stirrup rotating about the pivotal axis which is generally aligned with the centerline of a person lying in the bed.

6 Claims, 7 Drawing Figures

TILTING ATTACHMENT FOR A BED

This invention relates generally to beds for invalids and the like, and is more particularly concerned with an attachment for a bed to render the bed tiltable without regard to the configuration of the bed itself.

There are numerous instances in which a person is confined to a bed for extended periods of time. Sometimes a person has a prolonged illness and is required to remain in bed for several weeks or several months. Also, a person who has lost the use of some portion of his body may be confined to bed for the rest of his life, except for relatively brief sojourns in a wheelchair or other conveyance. Regardless of the reason for a person's being confined to bed, it is important for the person to be as active as possible in order to facilitate circulation of blood.

If a person lies in a bed without moving for extended periods of time, the lack of blood circulation occasioned by the weight of the body's pressing against the bed leads to necrosis in those portions of the body touching the bed. The necrotic tissue may extend to some considerable depth if the person remains immobile for a sufficient length of time, thereby greatly increasing the discomfort of being confined to bed.

In the case of a person who has adequate use of his muscles, movement to prevent necrotic areas, or bed sores, does not present a problem. However, in the case of a person who cannot move himself, there is a constant problem in that an attendant must move the patient periodically. This movement of the patient usually takes the form of having an attendant manually lift the patient and roll him over on a different portion of the body. Such turning of a patient requires considerable strength on the part of an attendant, and some very heavy patients may require two or more attendants. If there is no attendant available, or no attendant strong enough, a patient may not be turned frequently enough and may develop extensive bed sores.

The general problem of moving, or turning, bed-ridden patients has been recognized in the past, and there have been some efforts made to solve the problems through the use of rocking or tilting beds. The prior art beds have included a multiplanar bed arranged so that the bed is tilted, and the patient rolls down-hill to a different plane, theoretically resting in a different position. There have also been beds that are arranged to rock, or tilt, and these beds have been generally undesirable in that: the axis about which the patient pivots has been far removed from the centerline of the patient, causing an unpleasant swaying sensation; the bed has been arranged so that the patient has the very unpleasant sensation of being confined within a box; and, the beds have been so complex and expensive that such beds have been effectively unavailable to those who need them.

The present invention overcomes the abovementioned and other difficulties with the prior art apparatus by providing an attachment for a bed, the attachment being usable with any form of bed whether simple cot or complex hospital-type bed, and regardless of the configuration and manipulation of the bed. The attachment of the present invention includes a base frame that is stationary relative to the floor or other supporting surface, and a receiving frame oscillable with respect to said base frame. The receiving frame is adapted for receiving a bed therein, and is pivotally connected to the base frame for oscillation about an axis that will lie generally at the surface of a mattress on a bed when the bed is in place on the receiving frame. The location of the axis of oscillation is such that a person lying on the bed will be rotated generally about his centerline. The present invention also includes a tilt control for shifting the receiving frame with respect to the base frame and retaining the receiving frame in the desired position.

These and other features and advantages of the present invention will become apparent from consideration of the following specification when taken in conjunction with the accompanying drawing in which.

Figure 1:
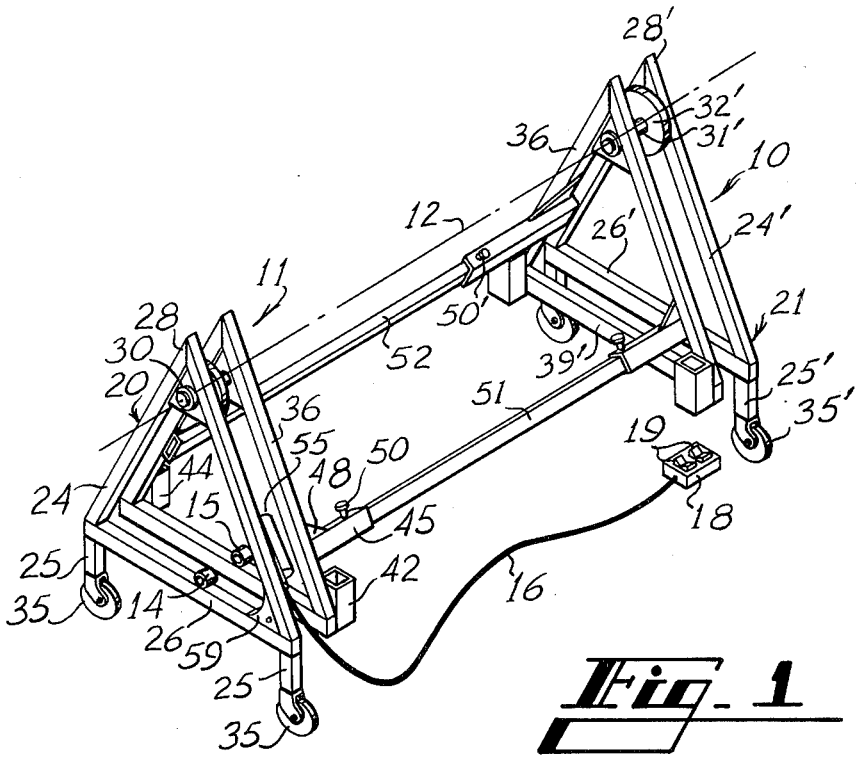
FIG. 1 is a perspective view of an attachment made in accordance with the present invention.

Referring now more particularly to the drawing and to that embodiment of the invention here presented by way of illustration, it will be seen in FIG. 1 of the drawing that the attachment includes a base frame 10 and a receiving frame 11. The receiving frame 11 is movable with respect to the base frame 10 by rotation about the axis designated at 12, and such rotation is brought about by proper adjustment of the tilt control 55 to be discussed hereinafter.

Figure 2:
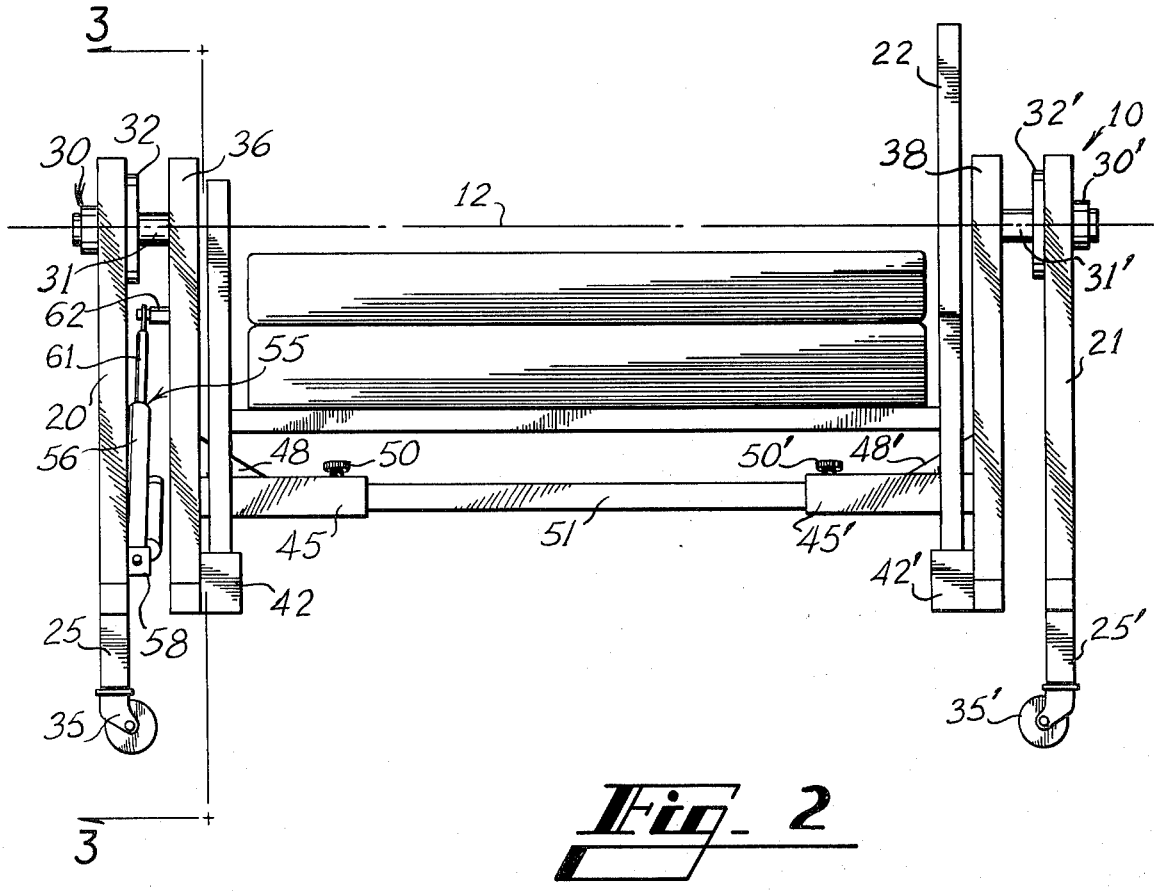
FIG. 2 is a side elevational view of the device shown in FIG. 1, the apparatus being illustrated with a bed in place on the receiving frame.

Referring to FIG. 2 of the drawing for a clearer understanding of the construction of the attachment of the present invention, it will be seen that the base frame 10 is made up of two stanchions 20 and 21. The stanchion 20 is here shown at the foot of the bed 22, and the stanchion 21 is shown at the head of the bed 22. While the bed can be oriented in either direction, the orientation shown places the control mechanism at the foot of the bed where it will be less disturbing to a patient in a bed.

Figure 3:
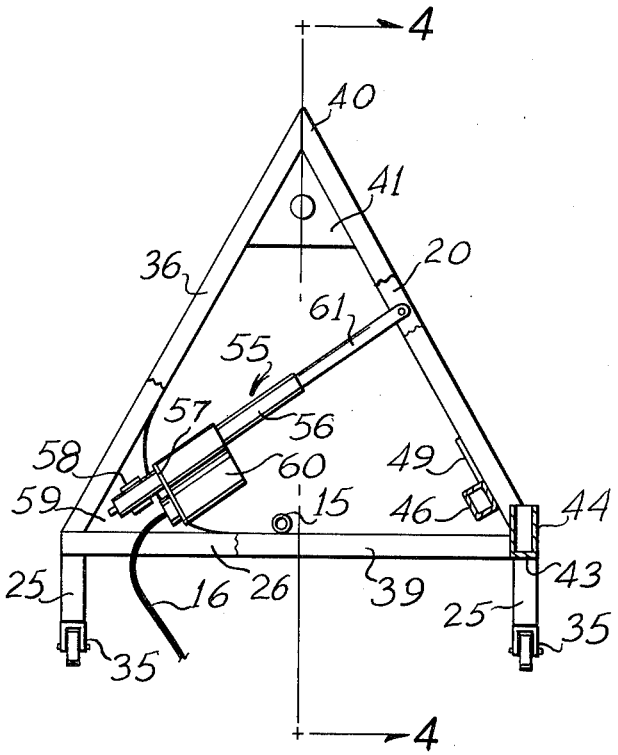
FIG. 3 is a cross-sectional view taken substantially along the line 3—3 in FIG. 2.
Figure 4:
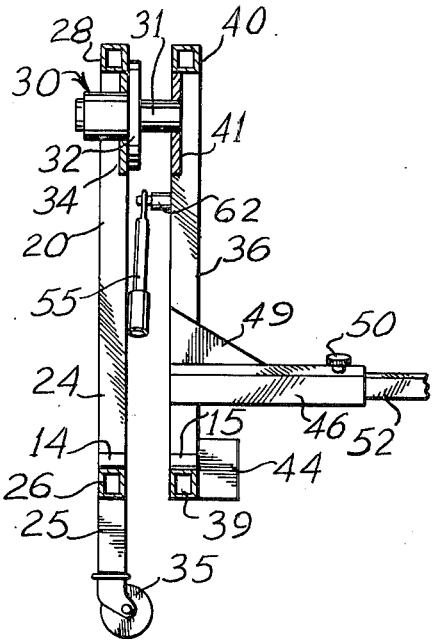
FIG. 4 is a cross-sectional view taken substantially along the line 4—4 in FIG. 3; and, FIGS. 5*a*, 5*b* and 5*c* are schematic illustrations showing the shift in body attitude as the receiving frame is tilted from level position.

With attention directed to FIGS. 3 and 4 of the drawing it will be seen that the stanchion 20 is made up of a triangular frame 24 having a pair of feet 25 extending from opposite ends of the base 26. The triangle is an isosceles triangle so that the apex 28 of the triangle is centered above the base 26. This centering is important because the tilting apparatus is supported by the apex 28 as will be discussed more fully hereinafter.

Looking especially at FIG. 4 of the drawing, there is a hub 30 fixed generally to the apex 28. Though many forms of construction may suggest themselves to the person skilled in the art, the object of the construction is to provide a bearing means for receiving an axle 31 and allowing the axle 31 to rotate as desired. The hub 30 is well suited to this purpose in that the hub 30 includes a flange 32 which can be welded, riveted, or otherwise affixed to the frame 24 at the apex 28. A strap 34 is here shown to render the construction more rigid, the strap 34 overlapping the flange 32 and being parallel to the base 26.

As described thus far, the stanchion 20 is like the stanchion 21, so the description will not be repeated for the stanchion 21 but like parts carry the primes of the numerals applied to the stanchion 20. In addition, the device is here shown as having casters 35 at the ends of the feet 25.

In assembling the stationary frame 10, the two stanchions 20 and 21 are located so the flanges 32 and 32' face each other for receiving the appropriate axles 31 and 31'.

The receiving frame 11 is made up of a pair of stirrups 36 and 38 having both a size and a shape similar to the triangular frame 24. Thus, the stirrup 36 is in the form of an isosceles triangle with a base 39 and an apex 40 centered on the base 39.

The stirrup 36 is, like the frame 24, formed as an open frame; but, the apex 40 has an axle plate 41 filling in a part of the open space, the axle plate 41 providing means for supporting the axle 31. This construction is well shown in FIG. 4 where it will be seen that the axle is fixed to the axle plate 41 and projects therefrom perpendicularly thereto. When the apparatus is assembled as shown, the axle 31 is received within the hub 30 so that the stirrup 36 is supported for rotation about the axle 31.

The lower edge of the stirrup 36 mounts a pair of receiving cups 42 and 44. The cups 42 and 44 are here shown as being fixed to the opposite ends of the base 39 as by welding or the like. It should nevertheless be understood that the cups 42 and 44 must be so spaced as to receive opposite legs of a bed to be received in the device. The device here shown by way of illustration was constructed so that the base 39 of the stirrup 36 is substantially the same width as the bed to be received in the device; however, the cups 42 and 44 could be differently located for different beds. Thus, one attachment could be made, and the receiving cups could be located differently to accommodate different beds. The cups 42 and 44 could, if desired, be movably fixed to the stirrup 36 so the location could be changed as required.

Each of the receiving cups 42 and 44 comprises generally a square receptacle having one wall thereof fixed to the stirrup 36. The receptacle includes a bottom 43 so a foot of a bed will rest on the bottom of the cup and be held against lateral movement by the side walls. It will therefore be understood that the cups 42 and 44 provide means for holding the weight of the bed, and also provide means for securing the bed against inadvertent movement as the bed is tilted.

Above the receiving cups 42 and 44, and along the side members of the stirrup 36, there is a pair of connecting members 45 and 46. The members 45 and 46 are welded or otherwise fixed to the side members of the stirrup 36, and are reinforced by gussets 48 and 49.

The members 45 and 46 are here shown as made of square tubing so the members are hollow; and, there is a set screw 50 in each of the members 45 and 46, the set screw 50 threadedly engaging the member 45 or 46 to frictionally engage another member received within the member 45 and 46.

From the foregoing description, it will be seen that the stanchion 20 has the stirrup 36 adjacent thereto, with the axle 31 journaled in the hub 30. The stirrup 36 is provided with the receiving cups 42 and 44 to carry one end of a bed 22, and the connecting members 45 and 46 serve to connect the stirrup 36 to the stirrup 38 through appropriate spacing members. It will therefore be seen that the bed in the cups 42 and 44 is held while the stirrup 36 is pivoted for swinging from side to side, pivoting about the axle 31. It will further be seen that the stirrup 36 is made like the stirrup 38, so no detailed description of the stirrup 38 is thought to be necessary, and the primes of the numerals applied to the stirrup 36 are applied to like parts of the stirrup 38.

Looking at FIGS. 1 and 2 of the drawing it will be realized that there is no connection between the stanchion 20 and the stanchion 21 other than their respective connections to the receiving frame 11. Because of this it is important that the pivotal connection consisting of the axle 31 and the hub 30 be strong enough to withstand the stress. One successful embodiment of the invention has used a vehicle axle and hub for this connection. Such a device inherently has the strength necessary, it has appropriate bearings and means for lubricating the bearings, so is admirably adapted to this use. It will of course be understood that any pivoting means with sufficient strength will work quite well, and the vehicle axle is given only by way of example.

Extending between the connecting members 45 and 46 on the stirrup 36 and the connecting members 45' and 46' on the stirrup 38 are extension members 51 and 52. The extension member 51 is received within the connecting member 45 and is held securely therein by the set screw 50. The opposite end of the member 51 is received within the connecting member 45' on the stirrup 38, and is secured by the set screw 50'. The same construction is used for the extension member 52.

As a result of this construction, the device of the present invention can easily be taken apart for shipping or storage or the like. By simply loosening the set screws 50 and 50', the extension members 51 and 52 can be removed, thereby leaving the device as the two separate stanchions with attached stirrups. Also, in the event a different length bed is encountered only the extension members 51 and 52 need to be changed, and this alteration can be made with few tools and by people having very little mechanical skill.

The final aspect of the device of the present invention is the means for causing the receiving frame to tilt as desired, and to remain in the tilted position as long as desired.

The tilt control is generally designated at 55 and is shown somewhat in FIGS. 1, 2 and 4, but is best shown in FIG. 3 of the drawing. The tilt control 55 shown in the drawing by way of example is made up of a conventional piece of equipment well known to those skilled in the art. The device is used in many forms of equipment such as hospital beds and the like to provide the necessary motion.

In general terms, the tilt control 55 comprises a gear box 57 having an extending end fixed to a clevis 58. The clevis 58 is pivotally fastened to a corner plate 59 which is secured to the stanchion 20. A motor 60 is adjacent to the gear box 57 and is drivingly connected thereto so that the motor 60 provides the power for the gear box 57.

Extending from the gear box 57, there is a cylindrical housing 56. Though not here illustrated, it will be understood by those skilled in the art that a threaded shaft is carried by the gear box 57 in driving relation, so that operation of the motor 60 causes rotation of the threaded shaft through a gear train. This threaded shaft is inside, and co-axial with, the cylindrical housing 57.

Received within the cylindrical housing 56 and extending therefrom is a movable shaft 61. The shaft 61 is pivotally fastened to the stirrup 36 by attachment to a boss 62 which projects from the side of the stirrup 36 as shown in FIG. 4.

The shaft 61 is hollow, and the end of the shaft 61 which is inside the housing 56 is provided with a nut, fixed inside the shaft 61. The threads in the nut mate with the threads on the threaded shaft.

It will therefore be seen that, as the motor 60 is operated, the gears within the gear box 57 will drive the threaded shaft, causing the threaded shaft to rotate about its axis. As the threaded shaft rotates, the nut will move along the shaft, causing axial motion of the shaft 61 with respect to the housing 56. The direction of rotation of the motor 60 determines the direction of rotation of the threaded shaft, consequently the direction of motion of the shaft 61 with respect to the cylindrical housing 56. When the motor 60 is operated in one direction, the shaft 61 will be projected from the housing 56, and when the motor 60 is operated in the opposite direction, the shaft 61 will be retracted into the housing 56.

As the tilt control 55 is operated, the stirrup 36 will be caused to pivot with respect to the stanchion 20. As the stirrup 36, hence the receiving frame 11, pivots about the hub 30, the bed 22 carried by the receiving frame will be tilted with respect to the horizontal. It will be understood that the structure of the tilt control 55 as discussed above is such that the housing 56 and the shaft 61 will maintain their relative positions once set because the pitch of the threads of the threaded shaft and the mating nut is such that a longitudinal force on the shaft will not cause rotation of the shaft.

For operation of the motor 60 to control the tilt of the device, there is here shown a line 16 terminating in a box 18 having appropriate switches 19. Such an arrangement could be used by a patient who has the use of at least one hand, or by an attendant. There are more sophisticated electronic controls available for others, and the present invention could make use of such control devices in lieu of the simple arrangement shown.

In the event the tilt control 55 fails or is removed for some reason, the stanchion 20 and the stirrup 36 are provided with cooperating locking means 14 and 15. As here shown, the locking means comprises a pair of cylinders 14 and 15 fixed to the bases 26 and 39 respectively. With the simple expedient of a bolt passed through the cylinders 14 and 15, the receiving frame 11 can be locked with respect to the stationary frame 10.

Figure 5A:
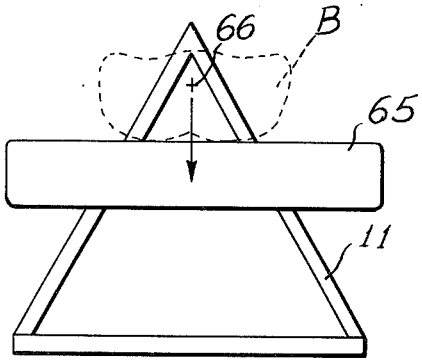
Figure 5B:
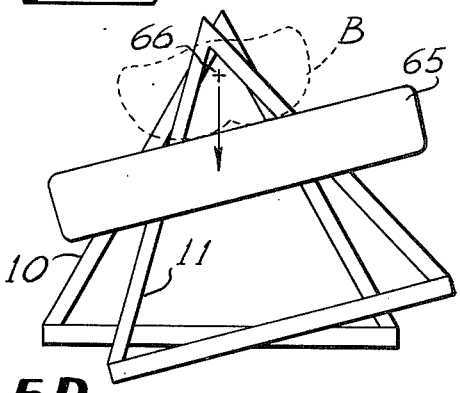
Figure 5C:
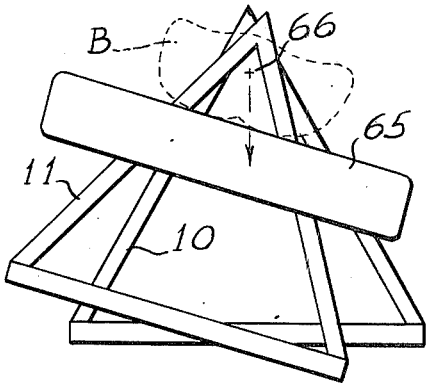

With the foregoing description of the apparatus in mind, attention is directed to FIGS. 5*a*, 5*b* and 5*c* of the drawing for a discussion of the operation of the device. FIG. 5*a* shows schematically a mattress 65 as it would be carried by a bed on the receiving frame 11 with the receiving frame 11 in a level position. A shape B indicated a person's body lying on the mattress 65, and it will be seen that the weight of the body B acting from the center of gravity 66 will urge the body B down uniformly against the mattress 65.

Realizing that blood must flow through all parts of the body to maintain the proper condition, it should be recognized that the body's pushing against the mattress 65 will restrict some blood circulation in the portions of the body receiving the greatest force. As a result, if a person remain in such a position for extended periods of time, necrotic areas will develop where the body touches the mattress 65.

Looking next at FIG. 5*b*, it will be seen that the body B is in virtually the same position with respect to the mattress 65; however, the tilt control 55 has been operated to cause the receiving frame 11 to pivot with respect to the stationary frame 10 so that the entire bed 22 and the mattress 65 have been tilted. In this new position, the body B acting from the center of gravity 66, redirects the weight of the body against the mattress 65. Thus, although the position of the body B with respect to the mattress 65 is unchanged, the areas in which the mattress 65 acts on the body B to restrict blood circulation have been changed.

In FIG. 5*c* of the drawing, the receiving frame 11 has been tilted in the opposite direction so that the force is again redirected.

FIG. 5 shows the extreme positions of the receiving frame 11, but from the foregoing description it will be realized that the degree of tilt is infinitely adjustable so that a person who is confined to bed can have maximum comfort through frequent shifting of body weight.

It will now be seen by those skilled in the art that the apparatus of the present invention provides a very simple device that can be used with almost any form of bed. With the apparatus a person who is confined to bed, such as a quadriplegic, can be tilted in one direction or another to have proper blood circulation in all parts of his body. A quadriplegic must normally be turned or shifted about once every two hours. This is very demanding on an attendant, and an impossible task if the patient is heavy and the attendant is not very strong.

The necessity for turning a quadriplegic is not necessarily to have different parts of the body against the mattress, but to relieve the pressure on a single area of the body to allow good blood circulation and prevent the necrosis that results from continued restricted circulation. Thus, the present invention provides a simple and widely adaptable solution to this problem.

It should be further noted that a conventional bed placed in the receiving frame 11 is in no way changed or hindered. Hence, even though the patient may have the head and/or foot of the bed elevated or otherwise manipulated, the entire bed can still be tilted to provide the relief desired.

Additionally, the device of the present invention is so arranged that a conventional bed is only slightly lifted from its normal level. This is important because almost all patients at times must be transferred to a wheelchair or some other device or conveyance, and if the bed is made too high the task is made very difficult.

It will of course be understood by those skilled in the art that the embodiment of the invention here shown is by way of illustration only, and is meant to be in no way restrictive; therefore, numerous changes and modifications may be made, and the full use of equivalents resorted to, without departing from the spirit or scope of the invention as defined in the appended claims.

I claim:

1. An attachment, for a bed having feet to support said bed and a mattress for supporting a person on said bed, said attachment including a base frame, said base frame comprising a pair of spaced stanchions, and a pair of journal means carried by said stanchions, a receiving frame carried by said base frame for receiving said bed, said receiving frame comprising a first stirrup having a base, an apex above said base and generally centrally thereof, said first stirrup being adjacent to one stanchion of said pair of stanchions, a first axle fixed to said apex and extending towards said one stanchion, said axle being journaled in one of said journal means, a second stirrup having a second base, a second apex above said second base and generally centrally thereof, said second stirrup being adjacent to the other stanchion of said pair of stanchions, a second axle fixed to said second apex and extending towards said other stanchion, said second axle being journaled in the other of said journal means, a plurality of securing means carried by said first base and said second base for holding said feet of said bed above a support surface, said first axle and said second axle being located along and coaxial with an axis, said axis being located so as to extend generally along the upper surface of said mattress and longitudinally thereof so that said axis is generally coincident with the center line of said person, means for selectively fixing said first stirrup with respect to said second stirrup for simultaneous movement, and tilt control means for rotating said receiving frame with respect to said base frame about said axis.

2. An attachment as claimed in claim 1, and wherein said means for selectively fixing said first stirrup with respect to said second stirrup comprises first stirrup connecting means, second stirrup connecting means, extension means extending between said first stirrup connecting means and said second stirrup connecting means and fixable to said first stirrup connecting means and said second stirrup connecting means.

3. An attachment as claimed in claim 2, said plurality of securing means comprising a plurality of receiving cups for receiving said feet of said bed, said receiving cups including side walls and a bottom, said plurality of receiving cups being spaced apart the same distance as said feet of said bed.

4. An attachment as claimed in claim 3, each stanchion of said pair of stanchions including an apex, said apex of one stanchion carrying one of said journal means, and said apex of said other stanchion carrying the other of said journal means.

5. An attachment as claimed in claim 4, said tilt control means comprising a first shaft fixed to said one stanchion of said pair of stanchions, a second shaft fixed to said first stirrup and parallel to said first shaft, and means for moving said first shaft and said second shaft longitudinally with respect to each other for causing said first stirrup to be moved with respect to said one stanchion.

6. An attachment as claimed in claim 5, and including selectively operable locking means for fixing said first stirrup with respect to said one stanchion.

* * * * *